United States Patent [19]

Dalglish

[11] 4,154,470

[45] May 15, 1979

[54] ROLL LIFTING APPARATUS

[76] Inventor: Herbert F. Dalglish, 284 Cherokee Ave., St. Paul, Minn. 55107

[21] Appl. No.: 852,087

[22] Filed: Nov. 16, 1977

[51] Int. Cl.[2] ..... B66C 1/54

[52] U.S. Cl. ..... 294/93; 414/626; 414/684; 414/911

[58] Field of Search ..... 294/67 C, 78 A, 86 LS, 294/93–97, 103 CG; 214/1 Q, 130 C, 650 R, 651, 652, 658, DIG. 1, DIG. 3, DIG. 4; 242/79

[56] References Cited

U.S. PATENT DOCUMENTS

| | | | |
|---|---|---|---|
| 1,868,562 | 7/1932 | Chubb et al. | 214/652 |
| 2,770,380 | 11/1956 | Anderson | 214/658 |
| 2,841,300 | 7/1958 | Berquist | 214/DIG. 1 UX |
| 2,932,420 | 4/1960 | Mako et al. | 214/658 |
| 3,264,029 | 8/1966 | Bellmann | 294/103 CG X |
| 3,734,328 | 5/1973 | Dalglish | 214/DIG. 4 X |
| 3,758,144 | 9/1973 | Dalglish | 294/97 X |
| 3,771,666 | 11/1973 | Fournier | 294/103 CG X |

*Primary Examiner*—Johnny D. Cherry

*Attorney, Agent, or Firm*—Merchant, Gould, Smith, Edell, Welter & Schmidt

[57] ABSTRACT

The disclosure is directed to apparatus adapted for attachment to an overhead crane which lifts and maneuvers material wound on rolls, coils, reels and spools. The apparatus comprises an elongated housing which is suspended in a generally vertical position at its upper end from the overhead crane. An elongated probe assembly constructed for insertion into one end of the roll core is pivotally mounted intermediate its ends to the lower end of the housing so that it is capable of swinging between vertical and horizontal positions. The probe itself includes means for expanding its effective diameter upon entry into the core, thus permitting it to be securely retained within the core and to lift the core from this single internal region of contact. The opposite end of the probe assembly is pivotally connected to the rod end of an hydraulic actuator which is pivotally mounted to the elongated housing. As connected, extension of the actuator rod swings the probe from the vertical to a horizontal position, and retraction of the rod returns the probe to the vertical position.

18 Claims, 13 Drawing Figures

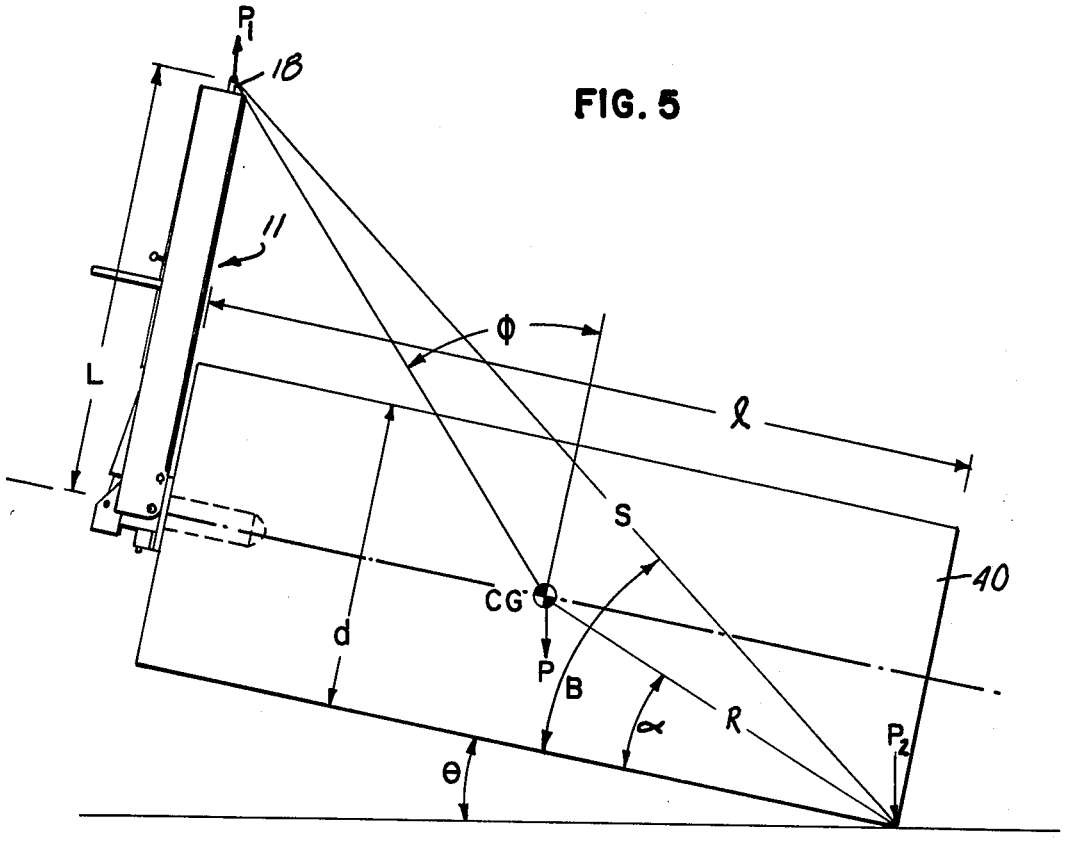
FIG. 5
FIG. 6
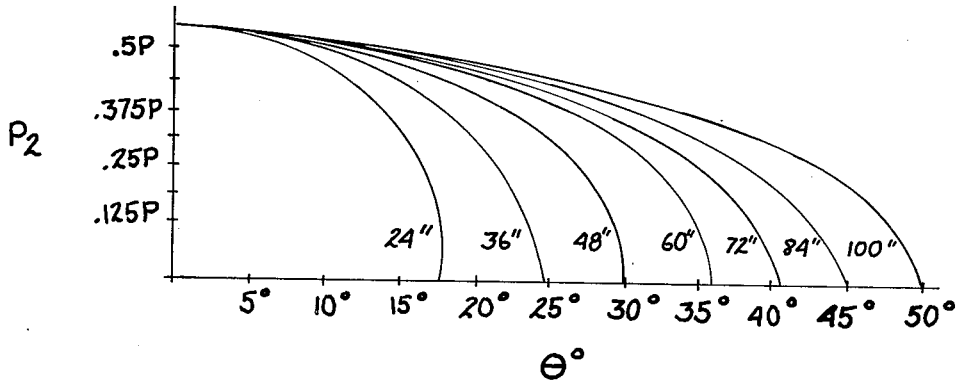

ROLL LIFTING APPARATUS

The invention relates generally to apparatus for lifting and maneuvering material wound on rolls, coils, reels or spools, and is specifically directed to lifting apparatus adapted for attachment to an overhead crane or the like which lifts and maneuvers the roll from one end.

Many products, such as paper, film, foil, textile, sheet metal, rope, yarn and wire are wound on rolls, coils, reels or spools which weigh from 50 to 10,000 pounds. Many cannot be lifted or maneuvered manually and require the intervention of some type of powered lifting apparatus.

Various devices are available, an example of which is my prior U.S. Pat. No. 3,734,328, entitled "Roll Lifter," which issued on May 22, 1973. Briefly, the prior patent discloses lifting apparatus specifically designed for use with an industrial lift truck, including a horizontally extending bracket assembly which can be elevated and lowered on the mast of the lift truck. A probe constructed for entry and expansion within the core or center of a coreless roll is pivotally connected at one end to the horizontal bracket, and is pivotally swung between vertical and horizontal lift positions by a chain and hydraulic actuator. Accordingly, the probe can be inserted with the rolls in either a vertical or horizontal position, and expansion of the probe within the core enables it to lift the roll through elevation of the lift truck. The roll can then be moved or swung to a different position.

The subject invention is similar to the apparatus disclosed in the aforementioned patent in that it includes a center lift probe of the same design which can be inserted into the roll core or coreless center and expanded to permit lifting of the roll. However, the subject apparatus is adapted for use with an overhead crane, and is uniquely constructed through its ability to tip the roll upward from a horizontal position and to thereafter lift the roll for repositioning either horizontally as before, or swung downward into a vertical position. This tipping and lifting concept is particularly advantageous because it permits an overhead crane to be quickly and easily adapted for use as a roll lifting device, notwithstanding the fact that the crane is flexible and capable only of lifting from a single point.

Many products, such as paper, film, and foil, are simply wound on flangeless cores so that the roll end shoulders are left unprotected. Generally, these ends must be protected so that the product is not crushed or otherwise damaged. In light of this, it has generally been accepted that an overhead crane cannot be used to pick up a horizontal roll from one end of the core since this would involve tipping the rolls onto the shoulder, thrusting virtually the entire weight of the roll onto the shoulder, thus crushing or tearing the material.

I have overcome this problem through recognition that the roll can be tipped and at the same time lifted from one end of the roll core without exerting undue forces on the roll shoulder or edge. In fact, the lifting apparatus is designed so that the load at the shoulder of the roll is at a maximum when tipping of the roll begins, and actually decreases with further tipping until it is entirely lifted from its supporting surface.

From the structural standpoint, this is accomplished through the use of an elongated housing which is suspended in a generally vertical position at its upper end from an overhead crane. An elongated probe assembly constructed for insertion into one end of the roll core is pivotally mounted intermediate its ends to the lower end of the housing so that it is capable of swinging between vertical and horizontal positions. The probe itself includes means for expanding its effective diameter upon entry into the core, thus permitting it to be securely retained within the core and to lift the core from this single internal region of contact.

The opposite end of the probe assembly is pivotally connected to the rod end of an hydraulic actuator, the hydraulic cylinder being pivotally mounted within the elongated housing. As connected, extension of the actuator rod swings the probe from the vertical to a horizontal position, and retraction of the rod returns the probe to the vertical position.

Various other components, including hydraulic devices and circuitry, are used in various embodiments of the invention. However, as described, the apparatus can be operated to position and maintain the probe in an essentially horizontal position, thus enabling it to be inserted into one end of a roll core. After actuating the probe to increase its effective diameter, the overhead crane can be operated to lift the horizontal roll. Initially, the end of the roll in which the probe is inserted is lifted from the supporting surface. At any given point in time, the magnitude of the force occurring at the opposite end shoulder of the roll is a function of the difference between the lifting force of the crane and the weight of the roll. As constructed, the lifting apparatus causes this force difference to decrease as the tipping angle increases; and ultimately, the lifting force becomes colinear with the center of gravity of the roll. At this time, the force occurring at the roll end shoulder decreases to zero and the roll is lifted from the supporting surface. The roll can then be moved by the overhead crane to a desired point and returned to its horizontal position through reversal of the process, or swung downwardly to a vertical position by releasing the hydraulic actuator through operation of the control circuitry. In the latter case, the roll is lowered to rest on its lower end, and the probe is operated to reduce its effective diameter and retracted for subsequent operations.

In one preferred embodiment, a closed hydraulic circuit is employed which uniquely utilizes the weight of the roll in swinging the probe downwardly to its vertical position to create potential energy which is thereafter utilized to return the probe to a horizontal position.

In another preferred embodiment, a reversible hydraulic pump is used to power the probe between vertical and horizontal positions. This arrangement additionally enables the apparatus to pick up a vertically standing roll and swing it into a horizontal position before lowering it to the supporting surface. A vacuum head may be used in connection with the lifting apparatus for operation against one roll end to preclude telescoping of a flangeless roll carrying materials such as paper, film, or sheet metal.

In another alternative embodiment, a reversible electric motor acting through a gear reduction unit is used to power the probe between vertical and horizontal positions. Operation of the apparatus is facilitated by a control box capable of remote use.

It will become further apparent from the drawings and detailed description below that the inventive apparatus is capable of converting an overhead crane into a roll lifting device by a simple hook connection with the crane. The apparatus is extremely simple, easy to use and maintain and conserves space.

BRIEF DESCRIPTION OF THE DRAWINGS

FIG. 5 is a view in side elevation of the inventive apparatus tip lifting a heavy roll, the figure showing also various operational parameters;

FIG. 6 is a graph indicating the relationship of the magnitude of the load on the shoulder of the roll, the length of the roll and the angle that the roll is tipped by the lifting apparatus;

DESCRIPTION OF THE PREFERRED EMBODIMENTS

Figure 1:
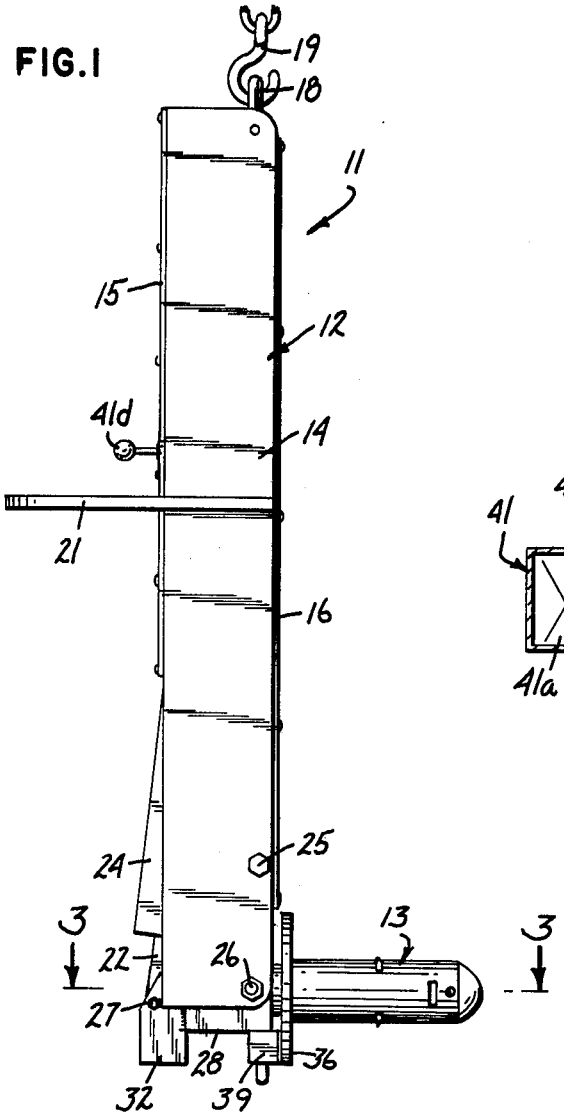
FIG. 1 is a view in side elevation of the inventive apparatus, showing in particular the elongated housing and its connection to an overhead crane, and the probe assembly in the horizontal lift position.
Figure 3:
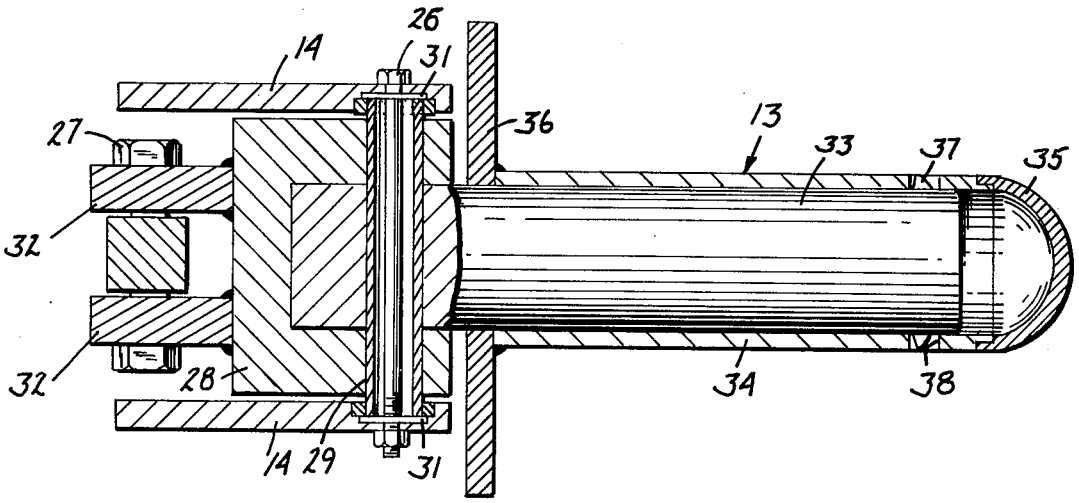
FIG. 3 is a sectional view of the probe assembly and its pivotal connection to the elongated housing, taken along the line 3—3 of FIG. 1.
Figure 2:
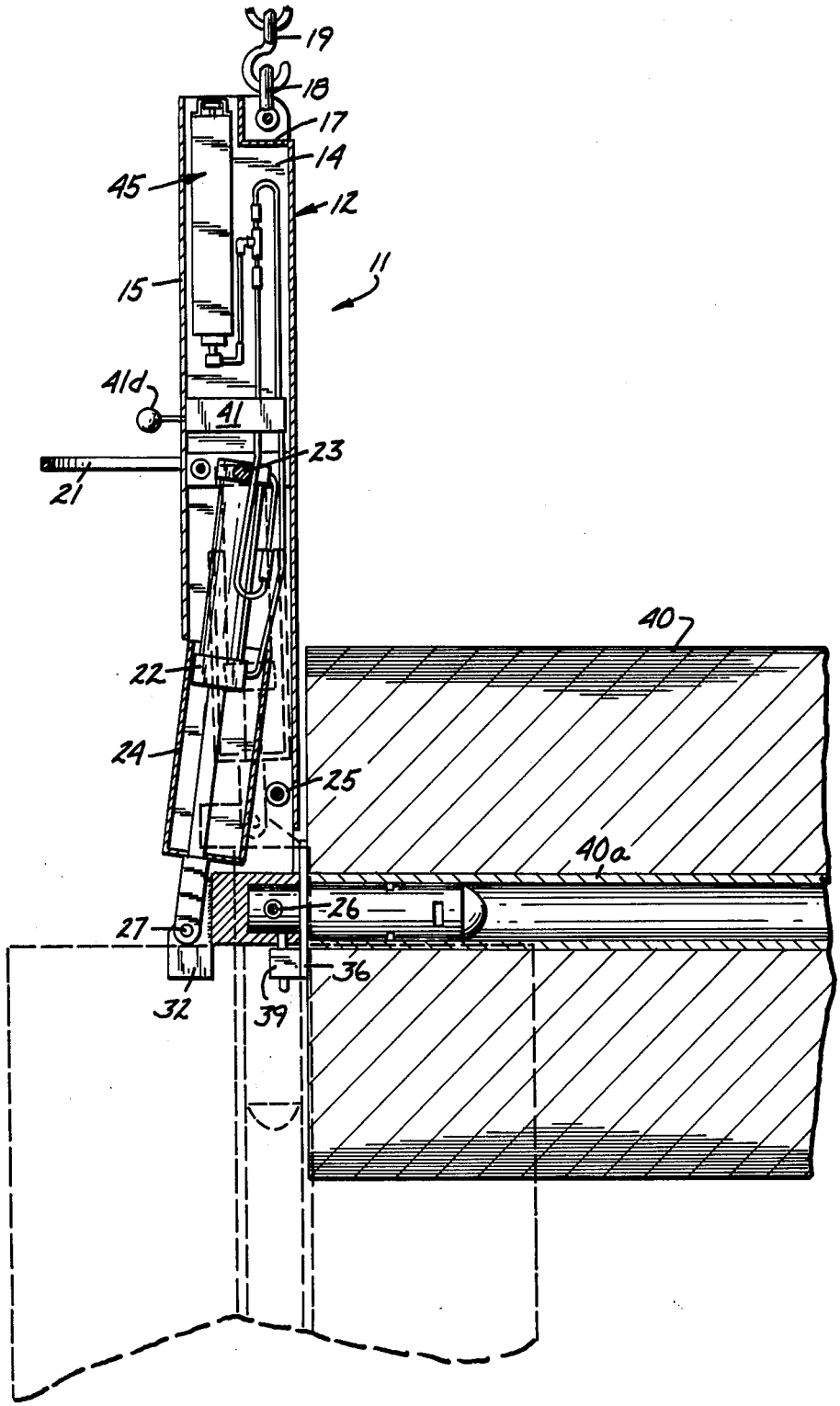
FIG. 2 is similar to FIG. 1, but with portions of the elongated housing removed to view the internal structure more clearly, the figure also showing the lifting apparatus with a heavy roll in two operative positions.

With initial reference to FIGS. 1-3, lifting apparatus embodying the inventive principles is represented generally by the numeral 11. Apparatus 11 broadly comprises an elongated housing 12 and a probe assembly 13. Housing 12 consists generally of an elongated box formed from metal plate, portions of which are open for operational purposes. The box housing is defined by opposed elongated sides 14, a back 15 rigidly connected between the sides 14, and a removable front 16. An angular corner member 17 is interconnected between the sides 14, defining a corner space in which an eye member 18 is pivotally connected to the housing. The eye 18 is adapted to receive the hook 19 of an overhead crane, thus enabling the crane to be converted to a roll lifting device by simply picking up the apparatus 11.

A loop handle 21 extends laterally and rearwardly from an intermediate point of the housing 12 permitting an operator to maneuver the apparatus 11 as will become apparent below.

The operational components contained within housing 12 include a hydraulic actuator 22, the cylinder portion of which is pivotally connected by a pivot pin 23 to the housing 15. A drip can 24, which catches any hydraulic fluid leaking from the cylinder, is rigidly secured to the lower end of the piston rod of actuator 22, and reciprocates with the rod as it is extended and retracted (see the dotted line position of FIG. 2). A stop 25 extending between the sides 14 abuts the piston rod in its retracted position (FIG. 2) preventing it from reaching an over center lateral position which would hinder proper operation.

Probe assembly 13 is generally elongated in shape and pivotally connected intermediate its ends to the lower end of the housing 12 by a pivot bolt 26. The forward portion of probe assembly 13 is constructed for retainable entry into the end of a roll core or center of a coreless roll, and the rearward end is pivotally connected to the piston rod of hydraulic actuator 22 by a pivot bolt 27. As best shown in FIG. 3, probe assembly 13 comprises a body 28 through which a bearing sleeve 29 passes. The sleeve 29 is received in opposed recesses formed in the sides 14 of housing 12, and rotation of the sleeve 29 is relative to a pair of bearing washers 31.

A pair of projecting members 32 extend rearwardly from the body 28, and the lower end of piston rod 22 is received therebetween and pivotally retained by the pivot bolt 27.

The probe itself consists of a stationary cylindrical member 33, which is securely retained within the body 28, and a slidable shell or sleeve 34, the outer end of which terminates in a nosepiece 35. An annular collar 36 is secured to the opposite end of the sliding sleeve 34. A plurality of teeth 37 of angular cross section are carried by the cylindrical member 33 and radially rockable in a like plurality of square openings 38. The teeth 37 are normally urged radially inward by resilient means not shown so as to be withdrawn from the openings 38. As shown in FIG. 3, the forward side of each tooth 37 is angular, so that rearward sliding movement of the sleeve 34 relative to the cylindrical member 33 enables the teeth 37 to rock within the associated opening 38 and thereby retract under the influence of the resilient means and contact with lower edge of square holes in sleeve 34. However, forward sliding movement of the sleeve 34 causes the edge of the associated opening 38 to engage the transverse rearward edge of each tooth 37, causing it to rock forwardly against the bias of the resilient means, causing it to project from its associated opening 38 for engagement with the core. Reference is made to my prior U.S. Pat. No. 3,423,120 for further details of the structure and operation of the probe assembly.

Probe 13 further comprises a control 39 which can be actuated to preclude relative movement between the sleeve 34 and cylindrical member 33. This is preferably accomplished by a transverse plunger which can be inserted into aligned transverse openings in the sleeve 34 and cylindrical member 33. Although this control structure is not shown, reference is again made to my prior U.S. Pat. No. 3,423,120, which discloses a similar probe assembly and locking arrangement.

Figure 4:
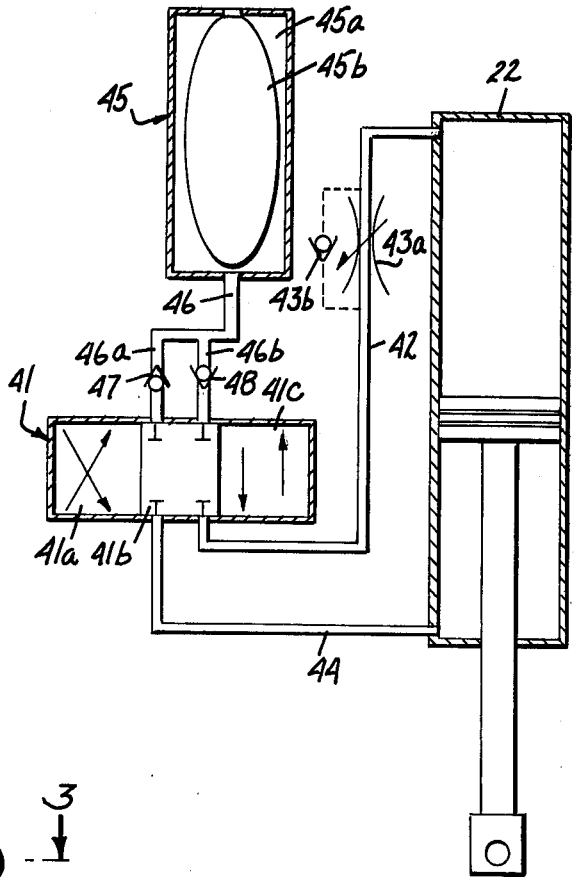
FIG. 4 is a schematic representation of the hydraulic circuit used with the inventive apparatus.

Also disposed within the elongated housing 12 are a number of other components making up the hydraulic circuit of FIG. 4. Like numerals represent like structure in FIGS. 2 and 4, although component representation is both structural and schematic.

The cylinder end of hydraulic actuator 22 is connected to one port of a three-way valve 41 through a hydraulic line 42. Valve 41 has three movable control sections 41*a*–41*c* which can be moved selective to the four inlet and outlet ports. Line 42 includes a combined variable restrictor 43*a* and check valve 43*b* connected in parallel. The opposite or rod chamber of the hydraulic actuator 22 is connected to a second port of the valve 41 by a hydraulic line 44.

On the opposite side of the three-way valve 41 is an accumulator 45 which defines an internal chamber 45*a* in which a resilient, closed pressurized bladder 45*b* is disposed. A hydraulic line 46 divides into parallel legs 46*a* and 46*b* which are connected to third and fourth ports of the three-way valve 41. Oppositely oriented check valves 47, 48 are disposed in the hydraulic legs 46*a*, 46*b*, respectively.

With reference to FIGS. 2 and 4, operation of the lifting apparatus 11 is as follows. It is initially assumed that the piston rod of the hydraulic actuator 22 is in its extended position (full lines of FIG. 2), so that the probe assembly 13 is swung into a horizontal lift position about the pivot bolt 26. In this regard, the term "horizontal lift position" is intended to be broad enough to encompass various positions of the probe which are not precisely horizontal. The operational objective is for the probe to be positioned transversely to the elongated housing 12 in a manner which permits entry into a roll lying on its side with the core in a horizontal position.

The crane is lowered until the probe is in a position for entry into one end of the core 40*a* of a roll 40. By manipulation of the apparatus 11 with the loop handle 21, the probe is inserted until the collar 36 abuts the roll end. With momentary reference to FIG. 3, during this inserting procedure the teeth 37 are maintained in a retracted position by frictional engagement of the sleeve 34 with the core 40*a*, the resilient teeth retaining means and the angular position of the teeth. Attempted retraction of the probe assembly 13 from the core at this point causes relative movement of the cylindrical member 33 relative to the sleeve 34, which in turn causes the teeth 37 to engage the edge of the openings 38. The teeth 37 are then rocked outwardly to their outward operating position in retaining engagement with the inner surface of the core 40*a*. Engagement of the teeth 37 with the core surface in this manner enables the core to be lifted and maintained, even in a vertical position.

Upward movement of the overhead crane at this point causes the roll 40 to be tipped about one shoulder. As will be discussed in further detail below, the tipping movement continues until the lifting force of the crane moves into alignment with the center of gravity of the roll 40, at which point the roll 40 is lifted from the floor or supporting surface.

The probe assembly 13 has been maintained in its horizontal lift position with the "dead end" section 41*b* of the three-way valve 41 in the operative position as shown in FIG. 4, which obviously precludes the flow of hydraulic fluid in the circuit. The same result is achieved with the "cross" section 41*a* of valve 41 in the operative position of communication with the valve ports. In this position, any load exerted on the probe assembly acts through the piston rod in an attempt to move it vertically upward. Such movement is, however, resisted by the fluid in the upper chamber of the actuator 22 and the fluid in hydraulic line 42, which is contained by the presence of check valve 47.

Accordingly, with the probe assembly 13 maintained in the horizontal lift position, the roll 40 can be lifted from its supporting surface and moved to another position. The roll 40 can be lowered to the same horizontal position if desired, by simply lowering the crane, or the valve 41 can be operated to swing the roll 40 downward into a vertical position to be lowered onto its end. This is accomplished by pulling the valve handle 41*d* (FIG. 1) so that the "aligned" section 41*c* of valve 41 is in operative position. This establishes fluid communication between the upper chamber of hydraulic actuator 22 and the accumlator 45 through the hydraulic lines 42, 46*b* and 46, which includes the variable restrictor 43*a* and check valve 48. Due to the variable restrictor 43*a*, the flow of hydraulic fluid to the accumulator 45 can be regulated so that downward swinging movement of the roll 40 to the vertical position is not excessively fast.

As hydraulic fluid enters the accumulator 45, the bladder 45*b*, which is normally pressurized with air or another compressible gas, becomes further compressed and at the same time creates potential energy. The use of this potential energy is discussed below.

With the roll 40 in a vertical position, the crane is lowered until the roll 40 comes to rest on its lower end. To retract the probe assembly 13, the apparatus 11 is lowered sufficiently so that the cylindrical member 33 slides downwardly within sleeve 34 by gravity. Movement of the sleeve 34 is restrained from downward movement by engagement of the collar 36 from the top of roll 40. This relative movement causes the teeth to rock inwardly to their retracted position by the influence of the resilient means and engagement of the teeth surfaces with the lower edge of the openings 38. The control 39 of probe assembly 13 can then be actuated to preclude relative movement between the sleeve 34 and cylindrical member 33, thus maintaining teeth 37 in their retracted position and permitting the probe assembly 13 to be removed from the core 40*a*.

If it is desired to return the probe assembly 13 to the horizontal lift position at this time, the three-way valve 41 is again moved to the "cross" position 41*a* establishing fluid communication from the accumulator 45 to the upper chamber of hydraulic actuator 22 through the hydraulic lines 46, 46*a* and 42. The potential energy accumulated by the compression of the bladder 45*b* causes hydraulic fluid to flow through this connection, which includes the check valve 47 and the parallel check valve 43*b*. At the same time, fluid in the lower chamber of actuator 22 leaves through the hydraulic line 44, check valve 48 and hydraulic line 46*b*, where it enters the line 46 for recirculation to the upper chamber of actuator 22 as needed.

FIG. 5 discloses the lifting apparatus 18 and roll 40 during the tipping operation, showing also the several operational parameters which permit the tip-lifting function without damaging a shoulder of the roll. The roll 40 has a width "l," a diameter d and a weight P acting through the center of gravity CG. The effective length or height of the lifting apparatus 11 is the distance between its point of support from the overhead crane and the longitudinal axis of the roll, and this distance is represented by the letter L. The distance between the point of apparatus support and the tipped shoulder is given the reference letter s, and the distance between the center of gravity CG and the tipped shoulder bears the reference letter R.

The load on the overhead crane, which appears at the point of apparatus support, is $P_1$, and the load at the tipped shoulder of the roll is $P_2$.

The angle subtended by the bottom of the roll (which is parallel to its longitudinal axis) and the supporting surface is $\theta$. The angle subtended between R and the bottom of roll 40 is $\alpha$, and the angle between s and the roll bottom is $\beta$. The angle subtended between a first line extending through the apparatus support and the roll center of gravity CG and a second line passing through CG and perpendicular to the roll longitudinal axis, which is constant, bears the reference symbol $\phi$. This angle is determined by the length of roll "l" and the effective height L of the apparatus, but is not dependent on the diameter d of the roll.

We wish to determine the load $P_2$ at the shoulder of the roll as the roll is tipped upwardly by the apparatus 11. Summing the forces in the vertical direction, we observe that $$P_2 = P - P_1.$$

We may determine $P_2$ as a function of the roll weight P, the distances R and s and the angles $\alpha$, $\beta$, and $\phi$ by summing the moments of all forces about the tipped shoulder with the roll 40 and lifting apparatus 11 in a given stationary position. Thus, $$R \cdot \cos(\alpha+\theta) \cdot P = s \cdot \cos(\alpha+\theta) \cdot P_1$$

$$P_1 = \frac{R \cdot \cos(\alpha + \theta)}{s \cdot \cos(\beta + \theta)} \cdot P$$

Substituting for $P_1$, we obtain $$P_2 = \left[1 - \frac{R \cdot \cos(\alpha + \theta)}{s \cdot \cos(\beta + \theta)}\right] \cdot P$$

As pointed out above, the angle $\theta$ is independent of the diameter of the roll, and represents the angle through which the roll must turn before it is lifted from the supporting surface. Thus, when $\theta$ equals $\phi$, $P_2$ is equal to 0.

FIG. 6 utilizes the formulas above in generating a plurality of curves showing the relationship of the tipping angle $\theta$, the roll width "l" and the load on the roll shoulder $P_2$. Each curve represents a roll of particular width. It will be noted that the greater the width of the roll, the greater the tipping angle required to lift it from its supporting surface. However, the load at the shoulder of the roll $P_2$ is at its maximum when the tipping angle is low, and is only a little over ½ of the entire roll weight even at the lowest tipping angles. As the tipping increases, the shoulder load $P_2$ decreases, thus insuring that the material at the roll shoulder is not damaged.

Figure 7:
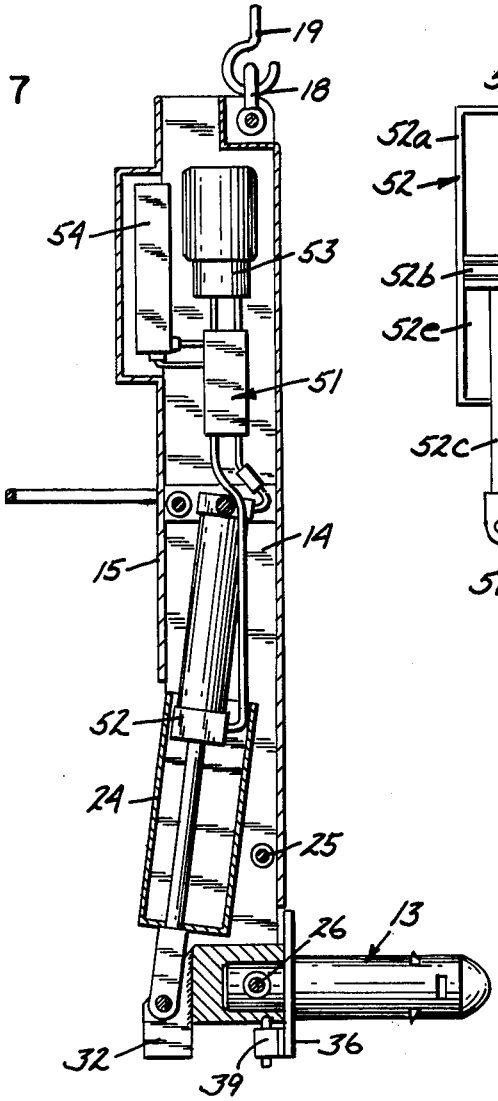
FIG. 7 is a view similar to FIG. 2 of an alternative embodiment of the inventive apparatus which employs a motor and hydraulic pump to move the probe assembly between vertical and horizontal lift positions.
Figure 8:
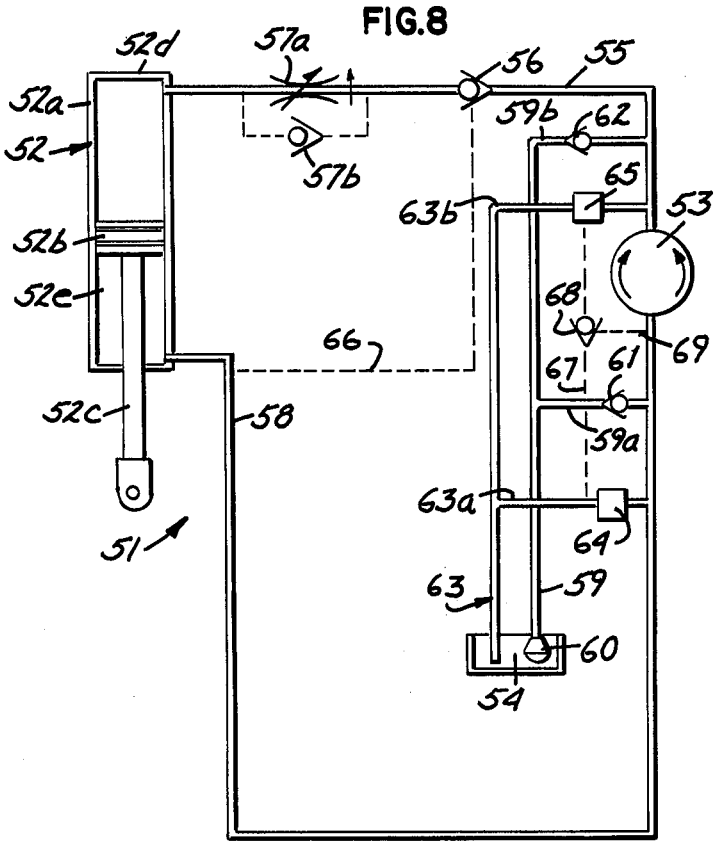
FIG. 8 is a schematic representation of the hydraulic circuit used with the apparatus of FIG. 7.

FIGS. 7–8 disclose an alternative embodiment of the invention which is capable, through externally supplied power, to lift the roll from a vertical to a horizontal position. This alternative apparatus is referred to generally by the numeral 51, but components which are identical to those of the apparatus 11 retain the same reference numeral. Further, the components which commonly appear in FIGS. 7 and 8 bear the same reference numeral even though they are shown both structurally and schematically.

The primary difference of apparatus 51 resides in the hydraulic circuit and components. The hydraulic circuit comprises a hydraulic actuator 52 consisting of a cylinder 25*a*, a piston 52*b* to which a rod 52*c* is connected, an upper or actuator chamber 52*d* and a lower or rod chamber 52*e*. The hydraulic circuit further comprises a motor driven, reversible hydraulic pump 53 and a reservoir 54 for hydraulic fluid.

A hydraulic line 55 including a check valve 56 and a combined variable restrictor 57*a* and a check valve 57*b* (which are connected in parallel) connects one side of the pump 53 with the upper chamber 52*d* of actuator 52. Preferably, the variable restrictor 57*a* is of the pressure compensated type, so that a selected setting maintains a constant flow through the device even though pressure in the hydraulic line may vary. A hydraulic line 58 connects the opposite side of the pump 53 with the lower chamber 52*e* of actuator 52. An inlet hydraulic line 59 having a filter screen 60 divides into legs 59*a* and 59*b* which are respectively connected to the hydraulic lines 58 and 55 to supply them with hydraulic fluid as is needed, depending on the direction of operation of pump 53. Leg 59*a* includes a check valve 61 and leg 59*b* includes a similar check valve 62, both of which prevent the reverse entry of hydraulic fluid in the line 59 by operation of the pump 53.

A hydraulic line 63 divides into a first leg 63*a* and a second leg 63*b* which are respectively connected with the hydraulic lines 58 and 55. The leg 63*a* includes a relief valve 64, and the leg 63*b* contains a similar relief valve 65. The hydraulic line 63 serves as a return to the reservoir 54, and the relief valves 64, 65 permit the return of hydraulic fluid to the reservoir 54 when pressure at their respective positions increases to a predetermined adjustable level.

Several of the components of the hydraulic circuit are pressure actuated, which permits them to operate as a function of hydraulic pressure at a different point within the circuit. Thus, check valve 56 becomes operable to permit the flow of hydraulic fluid from the pump 53 to the upper actuator chamber 52*d* only if pressure in the lower actuator chamber 52*e* is at a sufficient level. This is sensed by a pilot line 66 connected between hydraulic line 58 and the check valve 56.

Relief valve 65 in leg 63*b* is also pressure actuated, and it is enabled to a state of being capable of providing relief only when pressure within the leg 63*a* has reached a predetermined level. This is sensed by a pilot line 67 interconnecting the leg 63*a* and relief valve 65. The pilot line 67 includes a pressure actuated check valve 68, which is enabled as a function of increasing pressure as sensed by a pilot line 69 connected between check valve 68 and hydraulic line 58 adjacent the pump 53.

As pointed out above, pump 53 is reversible in nature, driven by an electrical motor, the operation of which can be reversed by polarity change. The electrical line to the pump/motor unit 53 has not been shown for purposes of clarity.

As described, operation of the apparatus 51 is as follows. With the probe 13 in its transverse or horizontal position as shown in FIG. 7, the crane can be lowered and the probe 13 inserted into a horizontal roll. The teeth 37 of probe 13 are extended as discussed above. The roll can thereafter be tipped and lifted generally as described in connection with apparatus 11.

to swing the roll downwardly into vertical position, pump 53 is operated to drive hydraulic fluid through hydraulic line 58 into lower chamber 52*e* of hydraulic actuator 52, thus causing the rod 52*c* to retract and lower probe 13. Hydraulic fluid cannot enter hydraulic line 59 due to check valve 61, and as long as piston 52*b* continues to move the pressure within hydraulic line 58 is insufficient to overcome and pass through relief valve 64.

However, pressure within lower chamber 52*e* is sufficient to operate check valve 56 via pilot line 66, thus permitting hydraulic fluid to escape upper chamber 52*d* and enter hydraulic line 55. This flow is regulated by variable restrictor 57*a*, since retraction of the actuator 52 is greatly assisted by the weight of the roll acting through the probe.

As pressure increases within hydraulic line 58 due to an increased build-up of pressure within upper chamber 52*d*, any excess in pressure may be relieved by relief valve 64, which permits fluid to return to reservoir 54 through hydraulic line 63.

The vertical roll of material may now be lowered to a supporting surface or on to a stack of rolls as is desired.

A vertical roll may be moved to a horizontal position by the following procedure. The probe 13 is inserted into the vertical core and the teeth 37 extended as before. The crane is raised, lifting the apparatus 51 and roll. With the apparatus 51 lifted sufficiently to give the roll of material enough clearance to be swung upwardly, the motor 53 is operated in the reverse direction of drive hydraulic fluid through hydraulic line 55 and into upper chamber 52*d* to extend the piston rod 52*c*. The check valve 57*b* bypasses the variable restrictor 57*a* and its delayed effect. Check valve 62 prevents the pump output from returning to the reservoir 54 via the inlet line 59.

Of course, the weight of the roll is significant, as is the pressure developed by pump 53 in upper chamber 52*d*. This pressure may very well exceed the limit pressure of relief valve 65, and it is therefore necessary to prevent relief valve 65 from operating at this time. This is accomplished by the pilot lines 67, 69 and check valve 68, operating in combination with relief valve 64. During this period of high load pressure, the pressure in hydraulic line 58 is low since is simply communicating all hydraulic fluid from lower chamber 52*e* to the inlet of pump 53. As such, pressure in line 58 is insufficient to pass through relief valve 64, and this in turn maintains the pressure in pilot line 67 at a low level. Ultimately, however, as the probe 13 reaches its transverse position, pressure builds within hydraulic line 58. To the extent hydraulic fluid is not required by the pump 53, operation of the relief valve 64 relieves this increasing pressure, permitting fluid to return to reservoir 54 through hydraulic line 63.

However, at the same time, pressure within hydraulic line 55 has also increased since piston 52*b* has come to a stop and pump 53 continues to operate. This pressure cannot initially be relieved because relief valve 65 has not been enabled. However, with increasing pressure in hydraulic line 58, this is communicated to check valve 68 by pilot line 69, which permits the pressure in leg 63 to be communicated to relief valve 65 through pilot line 67. Once the pressure in pilot line 67 has reached a predetermined level, relief valve 65 is enabled, and if its upper limit is exceeded it performs a relieving function and permits hydraulic fluid in hydraulic line 55 to return to reservoir 54 through return line 63.

With the roll of material swung upwardly to a horizontal position, the crane can now be lowered and the roll placed as desired.

Figure 9:
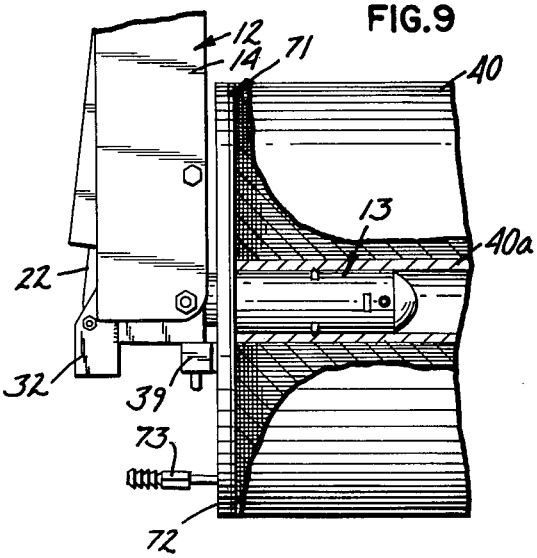
FIG. 9 is a fragmentary view of a further alternative embodiment of the inventive apparatus, portions broken away and shown in section, showing in particular a vacuum head used in connection with a flangeless roll for preventing telescoping of the roll material.
Figure 10:
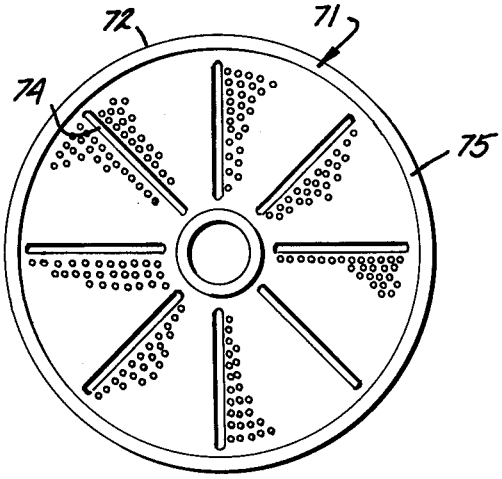
FIG. 10 is a view in bottom plan of the vacuum head of FIG. 9.

FIGS. 9 and 10 are directed to a further alternative embodiment of the invention, which makes use of a vacuum head to prevent the telescoping of certain rolls of material. The vacuum head replaces the collar 36 of apparatus 11, and preferably has a diameter that corresponds to the diameter of the roll with which it is used (FIG. 9). The vacuum head, which is referred to generally by the numeral 71, comprises a hollow disc 72 defining an internal vacuum chamber (not shown). A barbed connector 73 adapts the unit for connection to a source of vacuum by a suitable flexible hose.

As shown in FIG. 10, the bottom surface of disc 72 comprises a punched plate formed with a plurality of radially extending openings 74 that open to the vacuum chamber. An annular sponge rubber spacer ring 75 extends around the periphery of the disc 72, and serves as the engaging surface for the roll of material.

As described, it will be appreciated that contact of the vacuum head 71 with the roll end, followed by application of vacuum through the fitting 73, will create a substantial vacuum force at the roll-vacuum head interface due to the substantial area of the bottom of disc 72. With the probe and roll of material in a lifting position, vacuum applied to the vacuum head 71 will preclude any telescoping effect of the outer layers of material relative to the inner layers.

Preferably, the probe is interlocked with the crane to prevent lifting if the vacuum head 71 is not energized, and to prevent de-energization of the vacuum system after the unit has been lifted.

Figure 11:
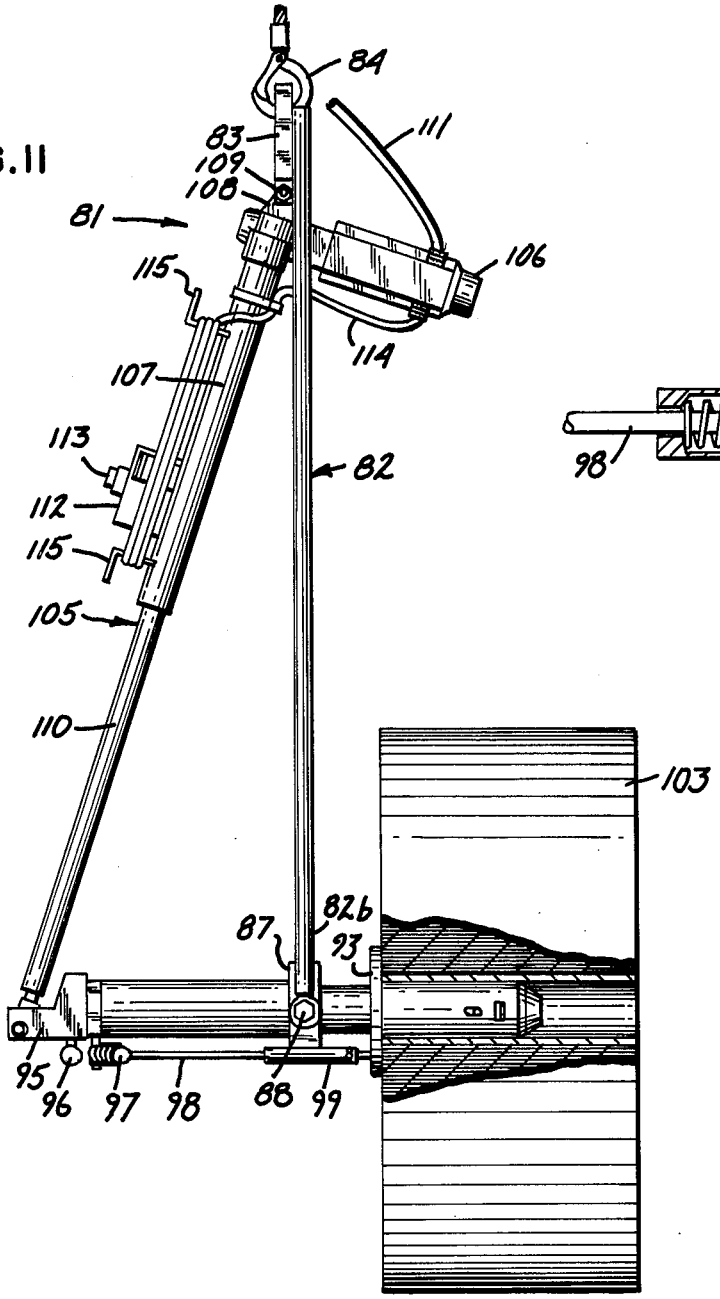
FIG. 11 is a view in side elevation of a further alternative embodiment of the inventive apparatus connected to an overhead crane, and with the probe assembly in a horizontal lift position.
Figure 13:
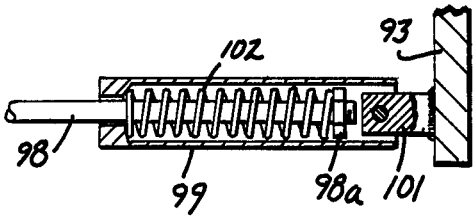
FIG. 13 is an enlarged fragmentary sectional view taken along the line 13—13 of FIG. 12.
Figure 12:
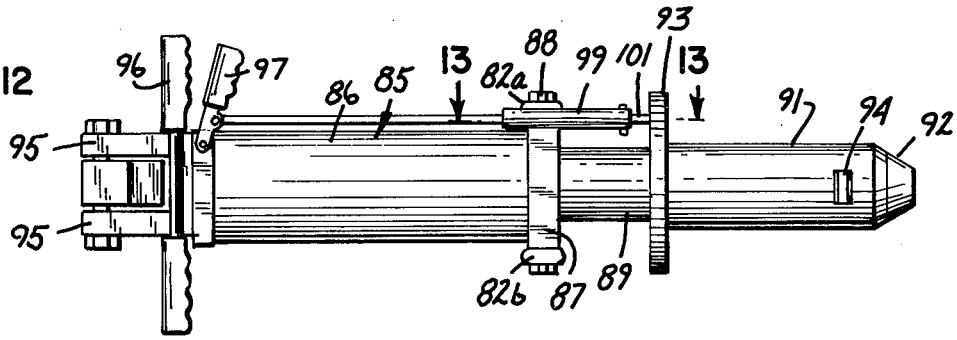
FIG. 12 is an enlarged view in bottom elevation of the apparatus in FIG. 11.

FIGS. 11–13 show a further alternative embodiment which also makes use of external supplied power to move a roll between vertical and horizontal positions. The apparatus, which bears the general reference numeral 81, comprises an elongated frame 82 formed from a pair of spaced frame members 82*a*, 82*b* (FIG. 12). A support block 83 is commonly secured to the upper end of the frame members 82*a*, 82*b*, maintaining them in the desired spaced relation, while at the same time offering a connection to the hook 84 of an overhead crane or the like.

The lower ends of the frame members 82*a*, 82*b* define a clevis which serves to pivotally carry a probe assembly 85. To this end, the probe assembly 85 includes a body 86 with a circular collar 87 secured thereto, and which is disposed at an intermediate point within the overall length of the probe assembly 85. The lower ends of the frame members 82*a*, 82*b* are pivotally connected to the circular collar 87 by a pivot bolt 88, as shown in FIG. 12.

As before, the probe itself consists of a stationary cylindrical member 89 which projects from and is carried by the body 86, and a slidable shell or sleeve 91 which terminates in a nose piece 92. A square collar 93 is secured to the sleeve 91 at the end opposite the nose piece 92. A plurality of teeth 94 are carried by the cylindrical member 89 in the same manner as hereinabove described.

A pair of projecting members 95 extend rearwardly from the body 86 to define a clevis the purpose of which is described in further detail below.

A pair of handles 96 are rigidly carried by the projections 95 and project laterally therefrom to permit manual movement of the apparatus 81 by an operator.

A third handle 97 is pivotally mounted to the body 86 adjacent the right handle 96. An elongated linkage rod 98 is pivotally connected to the handle 97 as shown in FIG. 12, extending forwardly for slidable insertion into a cylindrical connector 99. The forward end of connector 99 is pivotally connected to an ear 101, which is affixed to the square collar 93.

As shown in FIG. 13, the extreme end of linkage rod 98 carries a spring retainer 98*a*, and a spring 102 is compressibly exposed between the retainer 98*a* and the inside end of the cylindrical connector 99. Thus, a described, squeezing of the handle 97 relative to the associated rigid handle 96 has the effect of pulling the square collar 93 and moving the sleeve 91 relative to the stationary cylindrical member 89. As described hereinabove, this causes retraction of the teeth 94 and enables removal of the probe assembly 85 from a roll 103 when the roll is in a horizontal or vertical at-rest position.

Movement of the probe assembly 85 between horizontal and vertical positions is accomplished by an actuator represented generally by the numeral 105. Actuator 105 comprises a reversible electric motor 106 that is rigidly connected at a right angle to a tubular body 107. The upper end of tubular body 107 defines an ear 108 which is pivotally connected to the support block 83 by a pivot bolt 109.

An extensible and retractable tube 110 is slidably carried within the tubular body 107. Extension and retraction of the tube 110 is effected through a gearing arrangement which does not form part of this invention. The gearing arrangement includes a gear and pinion set coupled to a jack screw and nut that travels with the extensible tube. The actuator further includes a bidirectional brake that permits movement when the motor is not turning, and a slip clutch that protects the actuator from overload. Reference is made to U.S. Pat. Nos. 3,559,499; 3,587,796 and 3,704,765 for further details of the actuator.

Motor 106 is energized through an electric powerline 111, and control of the motor is accomplished through a control box 112 having a forward/reverse switch 113. Control box 112 is removably mounted on the tubular body 107, and it is connected to the motor 106 through an electric control line 114. Control line 114 is of sufficient length to permit removal of the control box 112 from the unit for remote control purposes. When the control box 112 is in mounted position, the control line 114 is wound on a pair of brackets 115 suitably mounted to the tubular body 107.

Operation of the apparatus 81 is generally similar to that of the previously described embodiments. With the probe assembly 85 in the horizontal position, the probe may be inserted into the core of roll 103 until the collar 93 engages the roll end. With the handle 97 released to its spring-biased position, the sleeve 91 slides to its outermost position. In this position, attempted retraction of the probe assembly 85 from the core of roll 103 causes the teeth 94 to rock radially outward into a position biting into the roll core inner surface.

In this position, the entire apparatus 81 and roll 103 may be elevated, and thereafter lowered either with the roll 103 in a horizontal position, or moved to a vertical position for stacking by operation of the motor 106 from the control box 112. In either case, after the roll 103 has come to rest on a supporting surface, the probe assembly 85 is removed by squeezing the handle 97 relative to the handle 96, which retracts the collar 93 and sleeve 91. This in turn causes retraction of the teeth 94 radially inward and permits removal of the probe from the roll core.

What is claimed is:

1. Apparatus for lifting and maneuvering a roll of material or the like having an externally accessible axial opening, comprising:

(a) an elongated frame having upper and lower ends and adapted to be raised and lowered by an overhead crane or the like;

(b) probe assembly means having first and second ends, the first end constructed for insertion into the roll opening and including mechanical means for increasing its external size within the roll opening for retainably engaging the roll;

(c) said probe assembly means being pivotally connected intermediate its first and second ends to the lower end of the elongated frame and swingably between a generally vertical position and a transverse lift positon;

(d) and control means operatively connected between said frame and the probe assembly means proximate its second end, the control means being operable to maintain the probe assembly means in the transverse lift position to permit lifting of the roll with its axis horizontally disposed, and to permit controlled movement of the probe assembly means from the transverse lift position to the generally vertical position under the influence of said roll of material.

2. The apparatus defined by claim 1, wherein the control means is constructed to move the probe assembly means from the generally vertical position to the transverse lift position.

3. The apparatus defined by claim 2, wherein the control means comprises hydraulic circuit means including:

(a) hydraulic actuator means having extended and retracted positions and connected so that the probe assembly means is in the transverse lift position with the actuator means in its extended position;

(b) pressure accumulator means for accumulating hydraulic fluid under pressure as the hydraulic actuator means moves from the extended to the retracted position;

(c) and control valve means for selectively releasing and transmitting the accumulated hydraulic fluid under pressure to the hydraulic actuator means to move the probe assembly means from the generally vertical position to the transverse lift position.

4. The apparatus defined by claim 3, wherein the control valve means comprises a control valve.

5. The apparatus defined by claim 3, wherein the hydraulic circuit means further comprises restriction means disposed between the hydraulic actuator means and the pressure accumulator means for restrictively regulating the flow of hydraulic fluid therebetween as the hydraulic actuator means moves from its extended position to its retracted position.

6. The apparatus defined by claim 3, wherein the hydraulic circuit means comprises a closed hydraulic circuit.

7. The apparatus defined by claim 3, wherein the hydraulic actuator means is pivotally connected between the elongated frame and the probe assembly means.

8. Apparatus for lifting and maneuvering a roll of material or the like having an externally accessible axial opening, comprising:

(a) an elongated frame having upper and lower ends and adapted to be raised and lowered by an overhead crane or the like;

(b) probe assembly means having first and second ends, the first end constructed for insertion into the roll opening and including mechanical means for increasing its external size within the roll opening for retainably engaging the roll;

(c) said probe assembly means being pivotally connected intermediate its first and second ends to the lower end of the elongated frame and swingable between a generally vertical position and a transverse lift position;

(d) and actuator means operatively connected between said elongated frame and the probe assembly means proximate its second end for moving the probe assembly means from the generally vertical position to the transverse lift position, and for maintaining the probe assembly means in either position, whereby the roll may be lifted from a horizontal or vertical position.

9. The apparatus defined by claim 8, wherein the actuator means is constructed to permit controlled movement of the probe assembly means from the transverse lift position to the generally vertical position under the influence of said roll of material.

10. The apparatus defined by claim 8, wherein the actuator means is constructed to move the probe assembly means from said transverse lift position to the generally vertical position.

11. The apparatus defined by claim 8, wherein the actuator means comprises reversible motor means which is selectively controlable to move the probe assembly means between said transverse lift position and said generally vertical position.

12. The apparatus defined by claim 8, wherein the actuator means comprises hydraulic circuit means including hydraulic actuator means extendable upon the application of hydraulic fluid to move the probe assembly means from the generally vertical position to the transverse lift position.

13. The apparatus defined by claim 12, wherein the hydraulic circuit means further comprises a reversible hydraulic pump operatively connected to the hydraulic actuator means, the hydraulic pump being selectively operable to extend or retract the hydraulic actuator means.

14. The apparatus defined by claim 13, wherein the hydraulic circuit means further comprises restrictor means disposed between the hydraulic pump and hydraulic actuator means for restrictively regulating the flow of hydraulic fluid therebetween when the probe assembly means is moved from the transverse lift position to the generally vertical position.

15. The apparatus defined by claim 8, wherein the actuator means comprises an extensible and retractable jack screw actuator, a reversible electrical motor operatively connected to the jack screw actuator, and switch means for controlling the direction of operation of the electric motor.

16. The apparatus defined by claim 15, which further comprises a control box for housing the switch means, the control box being removably mounted on the elongated frame and electically connected with the electric motor to permit remote control thereof.

17. The apparatus defined by claim 1, wherein the mechanical means are lockable to maintain the diameter of the probe assembly means at the externally increased size.

18. The apparatus defined by claim 8, wherein the mechanical means are lockable to maintain the diameter of the probe assembly means at the externally increased size.

* * * * *

UNITED STATES PATENT AND TRADEMARK OFFICE

CERTIFICATE OF CORRECTION

PATENT NO. : 4,154,470

DATED : May 15, 1979

INVENTOR(S) : Herbert Francis Dalglish

It is certified that error appears in the above-identified patent and that said Letters Patent are hereby corrected as shown below:

Column 7, line 28, the formula "$R \cdot \cos(\alpha + \theta) \cdot P = s \cdot \cos(\alpha + \theta) \cdot P_1$" should be changed to --$R \cdot \cos(\alpha + \theta) \cdot P = s \cdot \cos(\beta + \theta) \cdot P_1$--.

Column 7, line 39, "the angle $\theta$" should be changed to --the angle $\phi$--.

Column 8, line 1, the numeral "25a" should be changed to --52a--.

Column 8, line 64, the word "to" should be changed to --The--.

Signed and Sealed this

*Twenty-fifth* Day of *September 1979*

[SEAL]

*Attest:*

*Attesting Officer*

LUTRELLE F. PARKER

*Acting Commissioner of Patents and Trademarks*